US005840206A

United States Patent [19]

Gacher et al.

[11] Patent Number: 5,840,206

[45] Date of Patent: Nov. 24, 1998

[54] NOZZLE FOR INTRODUCING A LIQUID METAL INTO A MOLD, FOR THE CONTINUOUS CASTING OF METAL PRODUCTS, THE BOTTOM OF WHICH HAS HOLES

[75] Inventors: Laurent Gacher, Sarreguemines; Jean-Michel Damasse, Isbergues; Gérard Raisson, Nevers, all of France

[73] Assignees: Thyssen Stahl Aktiengesellschaft, Duisberg, Germany; Usinor Sacilor, Puteaux, France

[21] Appl. No.: 725,902

[22] Filed: Oct. 4, 1996

[30] Foreign Application Priority Data

Oct. 30, 1995 [FR] France ..... 95 12764

[51] Int. Cl.[6] ..... B22D 11/10

[52] U.S. Cl. ..... 222/594; 222/606; 164/437

[58] Field of Search ..... 222/606, 607, 222/594; 266/236; 164/437, 335, 337

[56] References Cited

U.S. PATENT DOCUMENTS 3,995,682 12/1976 Fekete et al. ..... 164/437

5,603,860 2/1997 Hohenbichler ..... 222/607

FOREIGN PATENT DOCUMENTS

| | | |
|---|---|---|
| 0401144 | 5/1990 | European Pat. Off. . |
| 2 233121 | 1/1975 | France . |
| 2700283 | 7/1994 | France . |
| 60-021171 | 2/1985 | Japan . |
| 1266950 | 1/1990 | Japan . |
| 6000600 | 1/1994 | Japan . |
| 2187404 | 9/1987 | United Kingdom . |

*Primary Examiner*—Scott Kastler

*Attorney, Agent, or Firm*—Sixbey Friedman Leedom & Ferguson; Thomas W. Cole

[57] ABSTRACT

The subject of the invention is a nozzle for introducing liquid metal into a mold for the continuous casting of flat metal products, having two large walls and two side walls, of the type having at its lower end two outlet ports which are made in its lateral wall opposite each other and intended to send the liquid metal each toward a side wall of said mold, and at least two holes made in the bottom of said lower end, wherein a first group of said holes is arranged on one side of a longitudinal plane of symmetry of the nozzle, which plane includes the axes of the outlet ports, and a second group of said holes is arranged on the other side of said plane of symmetry.

7 Claims, 4 Drawing Sheets

1
2
15
10
5
18'
7
8
III a
3
2'
1'
18
7'
9
III a

4'
3'
10
h
III b
5
18
III c
III c
15
2
10
III b
13
12
1
4
3
9
8

15
10'
18
10
18'

NOZZLE FOR INTRODUCING A LIQUID METAL INTO A MOLD, FOR THE CONTINUOUS CASTING OF METAL PRODUCTS, THE BOTTOM OF WHICH HAS HOLES

FIELD OF THE INVENTION

The invention relates to the continuous casting of metals, especially of steel. More precisely, it relates to the tubes made of refractory called "nozzles" which, usually, are connected via their upper end to the container serving as a reservoir of liquid metal and the lower end of which nozzles dips into the pool of liquid metal contained in the mold where the solidification of the metal product should start. The primary role of these nozzles is to protect the stream of liquid metal from atmospheric oxidation over its path between the container and the mold. These nozzles also allow, by virtue of suitable configurations of their lower end, the flows of liquid metal in the mold to be favorably oriented so that the product solidifies under the best possible conditions.

PRIOR ART

Casting may take place in a mold having to confer on the product a cross section of highly elongate rectangular shape, which is usually denoted by the term "flat product". This is the case when, in steelmaking, the steel is cast in the form of slabs, that is to say of products having a width of approximately 1 to 2 m and a thickness which is generally about 20 cm but which may be as low as a few cm in certain recent plants called "thin-slab casting machines". In these examples, the mold is composed of fixed walls vigorously cooled on their face which is not in contact with the metal. Plants are also being experimented with which allow steel strip a few mm in thickness to be obtained directly by solidification of the liquid metal. To do this, molds are used whose casting space is delimited on its large walls by a pair of internally-cooled rolls, having parallel horizontal axes and rotating about these axes in opposite directions, and on its short sides by closure plates (called side walls) made of refractory which are applied against the ends of the rolls. The rolls may also be replaced by cooled endless belts.

In these types of mold, it is considered necessary to orient the flows of the liquid metal uniformly toward the rolls and also toward the side walls of the casting space. It is thus sought, in particular, to obtain uniform heat distribution in the metal so as to reduce the variations in the solidified thickness along the perimeter of the mold. This uniform heat distribution and the agitation of the liquid pool which it requires are particularly crucial in the case of thin-strip casting because of the use of side walls made of refractory. This is because should there be no forced replenishment of metal adjacent to these side walls, this metal would be subjected to abnormally intense cooling. In this case, undesirable solidification of metal on the side walls would appear, in particular in the vicinity of their region of contact with the rolls. This orientation is conventionally achieved by forcing the metal to leave the nozzle via two holes called "outlet ports" made opposite each other on the lateral wall of the lower part of the nozzle, and not via a single hole provided in the bottom of the nozzle. Usually, after having left an outlet port and having struck the short side of the mold, the liquid metal divides into two recirculation loops. An upper loop licks the surface of the metal present in the casting space before going back down along the nozzle, while the lower loop starts by going down along the short side of the mold before going back up toward the outlet port.

In order to obtain the desired uniform distribution, two-part nozzles are sometimes used, especially in twin-roll casting (see the document JP-A-60,021,171). The first part is composed of a cylindrical tube whose upper end is connected to a hole made in the bottom of the tundish which forms the reservoir of liquid steel feeding the mold, which hole can, if required, be closed off by the operator, partially or completely, by means of a stopper rod or a slide-gate system regulating the flow of metal. The maximum flow rate of metal which can flow into the nozzle depends on the cross section of this hole. The second part, which is fixed to the lower end of the above tube, for example by screwing, or which is constructionally integral with it, is intended to be immersed in the pool of liquid metal present in the mold. It is composed of a hollow element into which runs the lower hole of the above cylindrical tube. The internal space of this hollow element has an elongate general shape and is oriented approximately perpendicularly to the tube. When the nozzle is in service, the hollow element is placed so as to be parallel to the large walls of the mold and the liquid metal flows out into the mold via two outlet ports made at each end of the hollow element.

It is also known to provide nozzles of one of the types which have just been described with one or more holes made in their bottom. The metal flowing out via this or these holes feeds hot metal directly to that part of the mold lying vertically beneath the nozzle, which improves the uniformity of the heat distribution in the casting space, especially near the rolls. When there is a plurality of these holes, they are aligned in a direction parallel to the general orientation of the outlet ports. These holes are sometimes called "leakage holes" (see, for example, the document FR 2,233,121) in the case where they have a small total area compared to that of the outlet ports. Their function is in this case also to dissipate a fraction of the energy of the metal which strikes the bottom of the nozzle, allowing some of this metal to flow out through the bottom. Thus, the amount of liquid metal which rebounds off the bottom and disturbs the uniformity of the upflow of metal through the outlet ports is limited. In all cases, the exit velocity of the metal in the region of the outlet ports is reduced, because they are filled more suitably. The outflows thus obtained are calmer and more uniform over time inside the mold, which enhances the quality of the cast product. Likewise, the rate at which the outlet ports become clogged up with the non metallic inclusions in the metal is slowed down.

In the case of nozzles for twin-roll casting of the type mentioned earlier, it is thus possible to arrange to use a row of such holes in the bottom of the nozzle, these holes being aligned in an orientation parallel to the general orientation of the hollow element, in the longitudinal plane of symmetry of the nozzle.

The drawback of the one or more nozzle bottom holes arranged in this way is that the hot metal flowing out through each of them tends to be entrained in the ascending part of the lower circulation loop of metal flowing out through the outlet ports. Consequently, only a small fraction of this hot metal manages to reach into the depths of the central part of the casting space and the function assigned to these holes of providing uniform heat distribution in this space is not correctly fulfilled.

SUMMARY OF THE INVENTION

The object of the invention is to provide a configuration of the lower part of the nozzle which makes it possible actually to achieve this uniform heat distribution using single nozzle bottom holes.

The subject of the invention is a nozzle for introducing liquid metal into a mold for the continuous casting of flat metal products, having two large walls and two side walls, of the type having at its lower end two outlet ports which are made in its lateral wall opposite each other and intended to send the liquid metal each toward a side wall of said mold, and at least two holes made in the bottom of said lower end, wherein a first group of said holes is arranged on one side of a longitudinal plane of symmetry of the nozzle, which plane includes the axes of the outlet ports, and a second group of said holes is arranged on the other side of said plane of symmetry.

As will have been understood, the invention consists in providing for the holes to be distributed no longer in the longitudinal plane of symmetry of the nozzle but distributed on either side of this plane of symmetry.

BRIEF DESCRIPTION OF THE DRAWINGS

The invention will be more clearly understood on reading the description which follows, given with reference to the following appended figures.

DESCRIPTION OF THE PREFERRED EMBODIMENTS

Figure 1C:
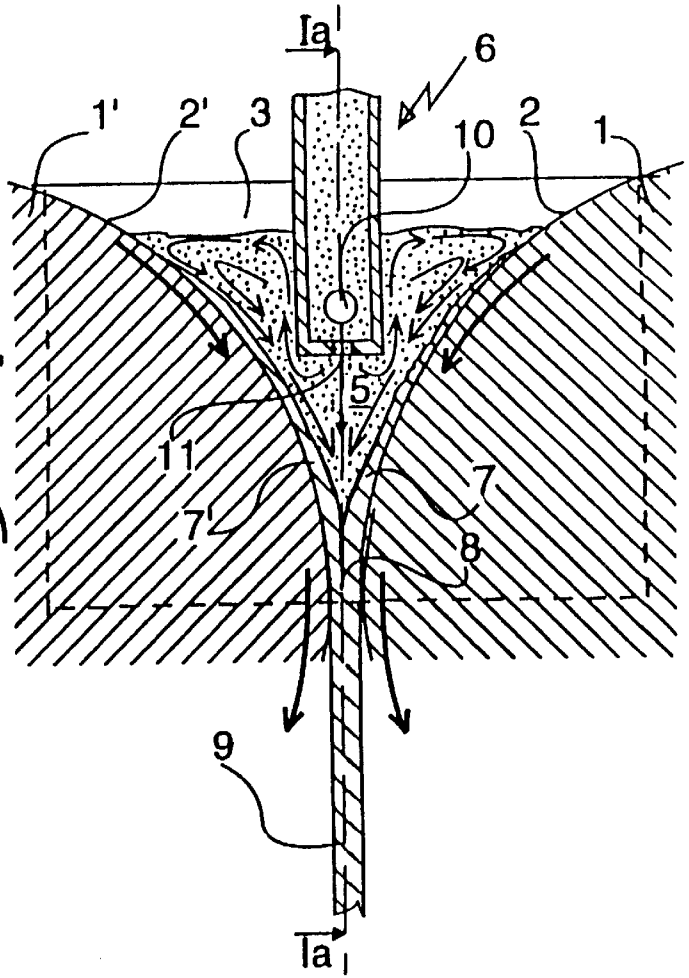
Fig 1c (PRIOR ART)
FIGS. 1*a* 1*b* and 1*c,* which diagrammatically show, in longitudinal section on Ia—Ia and in cross section on Ic—Ic, the casting space of a twin-roll casting mold and the general orientations of the flows of liquid metal in the case of the use of a conventional nozzle having a single bottom hole, this nozzle being seen in FIG. 1*b* in cross section on Ib—Ib.
Figure 1A:
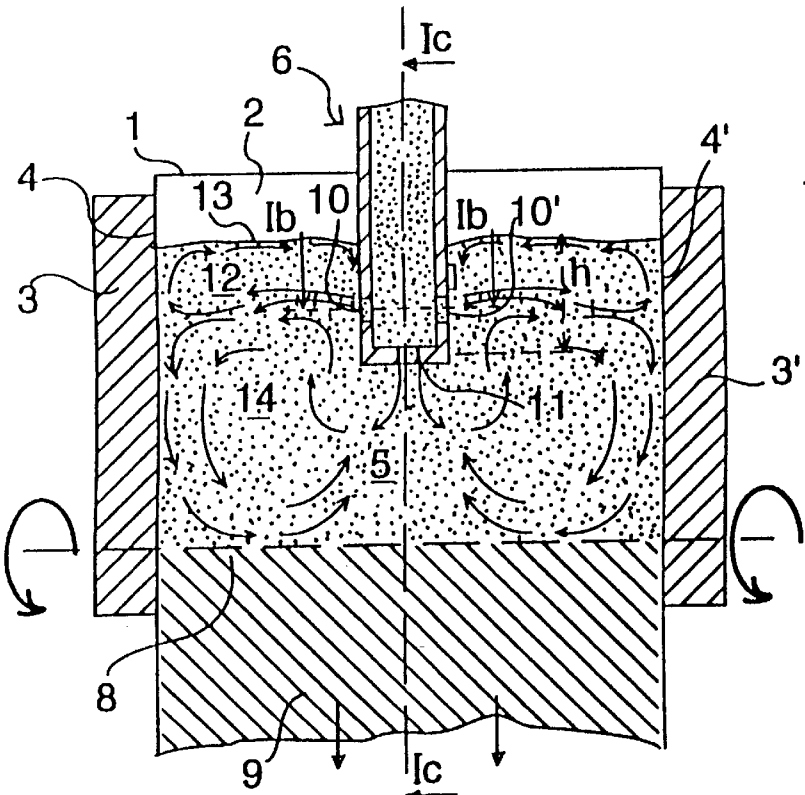
Fig 1a (PRIOR ART)

The plant for the continuous casting of a liquid metal, such as steel, in the form of thin strips, shown in FIGS. 1*a* and 1*c* comprises, as is known, two rolls 1, 1' having horizontal axes, these rolls being rotated in opposite directions about their axes and vigorously internally cooled. Their cylindrical lateral surfaces 2, 2' define between them a casting space which is closed off laterally by two side walls 3, 3' made of refractory which are applied against the ends 4, 4' of the rolls 1, 1'. The liquid metal 5 is introduced into this casting space via a nozzle 6 connected to a tundish, not shown, containing a reservoir of said metal 5. The metal 5 solidifies against the cooled walls 2, 2' of the rolls 1, 1' and forms skins 7, 7' of increasing thickness which join up in the neck 8, that is to say in the region where the distance between the surfaces 2, 2' of the rolls 1, 1' is least, this distance being equal to the thickness of the strip which it is desired to cast. Beneath the neck 8, there is therefore a solidified strip 9 which separates from the rolls 1, 1' and is extracted from the plant by a known device, not shown.

Figure 1B:
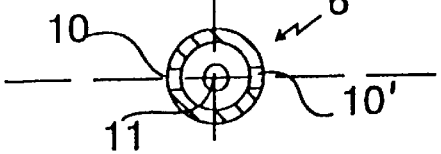
Fig 1b (PRIOR ART)

According to a known prior art, the nozzle 6 takes the form of a refractory tube whose end is immersed to a depth h in the liquid metal 5 present in the casting space. The liquid metal 5 flows out into the casting space through two cylindrical outlet ports 10, 10' made in the lateral wall of the nozzle 6. These outlet ports 10, 10' are diametrally opposed in the cross section of the nozzle 6 (see FIG. 1*b*), each being oriented approximately horizontally, facing one of the side walls 3, 3'. As is also known, the nozzle 6 has, in the case shown, a single vertical bottom hole 11 made in its bottom. By way of example, the cast metal is steel and the main dimensions of the various parts of the plant are:

- length and diameter of the rolls 1, 1': 860 and 1500 mm;
- width of the casting space in the region of the neck: 3 mm;
- depth of the pool of liquid metal 5 in the casting space: 400 mm;
- immersion depth h of the nozzle 6: 40 mm;
- internal and external diameters of the nozzle 6: 60 and 100 mm;
- diameter of the outlet ports 10, 10': 40 mm;
- diameter of the bottom hole 11: 15 mm In FIGS. 1*a* and 1*c,* the preferred directions of the flows of liquid metal 5 are shown by arrows. FIG. 1*a* shows the flow in the longitudinal mid-plane Ia—Ia of the mold. As is conventionally the case in continuous casting, and not only in continuous casting of thin products, the metal leaving the outlet port 10 is directed toward the side wall 3 and, close to it, is divided into two recirculation loops. A first loop 12, which is initially ascending, returns toward the nozzle 6 by licking the surface 13 of the pool of liquid metal 5 contained in the casting space and then goes back down along the nozzle 6. A second loop 14, initially descending, is directed tangentially to the side wall 3 and then to the neck 8, before going back up along the transverse mid-plane Ic—Ic of the casting space toward the nozzle 6. Flows symmetrical to the previous ones with respect to this transverse mid-plane Ic—Ic are observed for the metal leaving the other outlet port 10'. The metal leaving the bottom hole 11 firstly flows vertically and is then taken up in the second loop 14. At approximately mid-height of the casting space, the metal tends to be entrained in the second recirculation loop 14 (or its mirror image). In fact, there is virtually no fraction of this metal reaching the neck 8 directly. Looking in FIG. 1*c* at the preferred flows in the transverse mid-plane Ic—Ic of the mold, it may also be seen that the metal leaving the bottom hole 11 tends to be entrained toward the upper regions of the mold shortly after it leaves the nozzle 6. As a result of these flows, those regions of the casting space lying vertically beneath the nozzle 6 are mostly fed only with metal which has already by its action a relatively long residence time in the casting space and which, in addition, has flowed close to the rolls 1, 1' and to the side walls 3, 3'. For these reasons, this metal is cooler than would be desirable for ensuring satisfactory uniform thermal distribution of the casting space. In particular, it is observed that the conditions of solidification of the central region of the strip 9 may, for this reason, differ substantially from those which prevailed in its lateral regions which are mostly fed with hotter liquid metal. Consequently, the solidification structure of the strip 9 is not even over the entire width of its core, which may lead to significant differences in the mechanical properties of the final product.

Figures 2A, 2B, 2C:
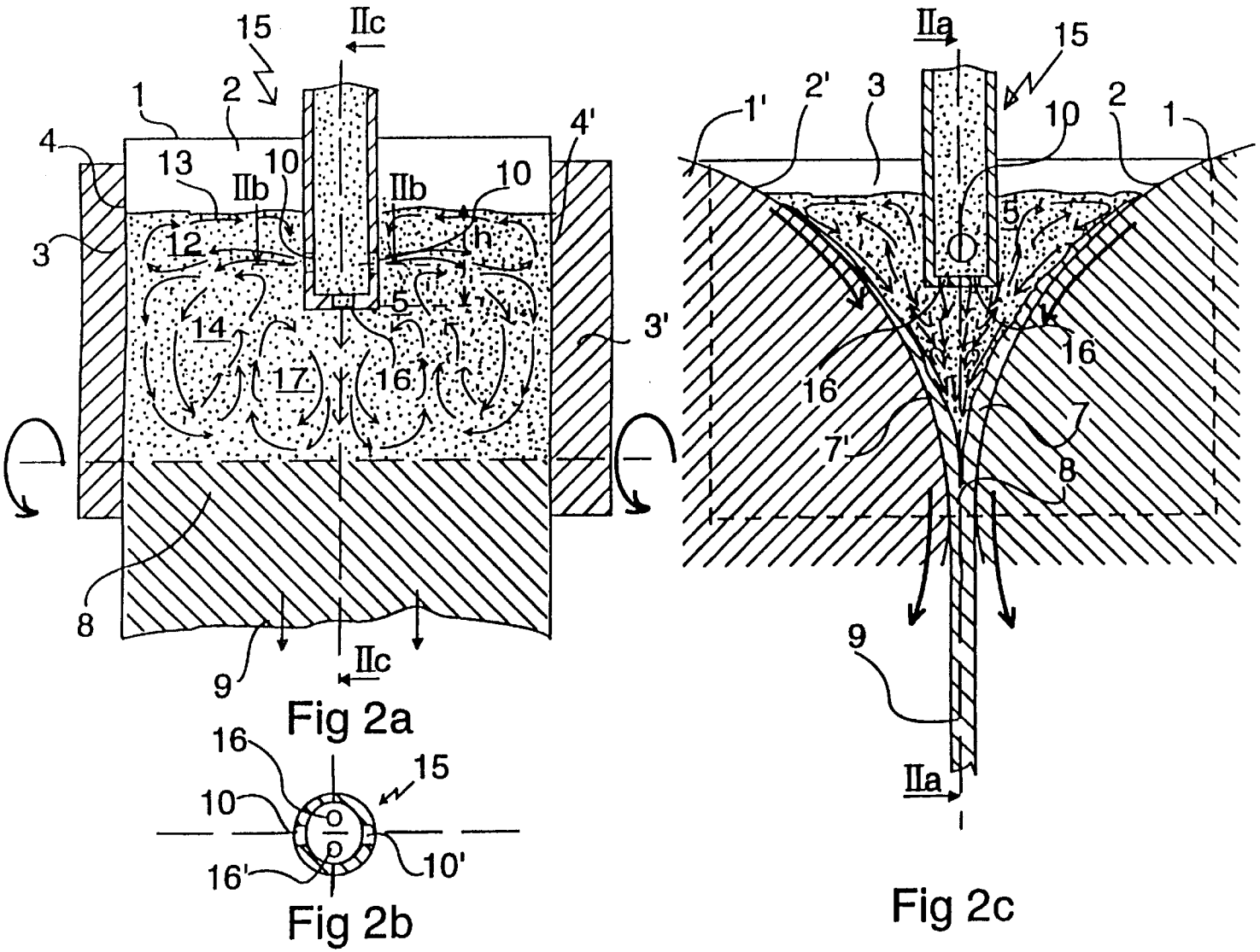
FIGS. 2*a* 2*b* and 2*c,* which diagrammatically show, in longitudinal section on IIa—IIa and in cross section on IIc—IIc, the casting space of a twin-roll casting mold and the general orientations of the flows of liquid metal in the case of the use of a first example of a nozzle according to the invention, this nozzle being seen in FIG. 2*b* in cross section on IIb—IIb.

The casting plant shown in FIGS. 2*a* and 2*c* differs from the previous one in that it is equipped with a nozzle 15 according to the invention, also shown in FIG. 2*b*. This nozzle 15 differs from the previous one in that it is equipped not with one but two vertical bottom holes 16, 16', these being aligned in a direction approximately perpendicular to the general orientation of the outlet ports 10, 10', as may be seen in FIG. 2*b*. They are therefore arranged on either side of the plane IIa—IIa which constitutes, for the nozzle 15, a longitudinal plane of symmetry which includes the axes of the outlet ports 10, 10'. These bottom holes have, for example, a diameter of 15 mm, the other conditions of use being identical to those in the previous example. The flows in the casting space are substantially modified compared to the reference configuration in FIGS. 1*a* and 1*c*. With regard to the flows of metal leaving the outlet ports 10, 10', as observed in the longitudinal mid-plane IIa—IIa of the casting space, there is again the first initially ascending first recirculation loop 12. The initially descending second recirculation loop 14 is also found again, but with regard to this second recirculation loop, the rise of the main stream of liquid metal 5 occurs substantially earlier than in the reference configuration. This is due to the presence of a third recirculation loop 17 which mainly contains liquid metal 5 emanating from the bottom holes 16, 16'. Since the parallel streams emanating from the bottom holes 16, 16' have a higher total flow rate than a single stream, they resist better the attraction exerted on them by the second loop 14 and are capable of descending as far as possible down into the casting space, i.e. as far as the neck 8 where they encounter the solidification front of the strip 9. The streams then flow firstly along this solidification front and finally rise back up toward the nozzle 6. Looking at the flows in the transverse midplane IIc—IIc, which are represented in FIG. 2*c,* also shows that the streams emanating from the bottom holes 16, 16' send the liquid metal 5 more deeply into the casting space than a single bottom hole. In addition, these streams have tendency to attract liquid metal 5 emanating from the upper regions of the casting space, which further improves the agitation of the pool and the uniformity of its heat distribution. Finally, since they are closer to the rolls than would be holes placed in the mid-plane of the nozzle 15, they provide more heat close to the rolls.

Figures 3A, 3B, 3C:
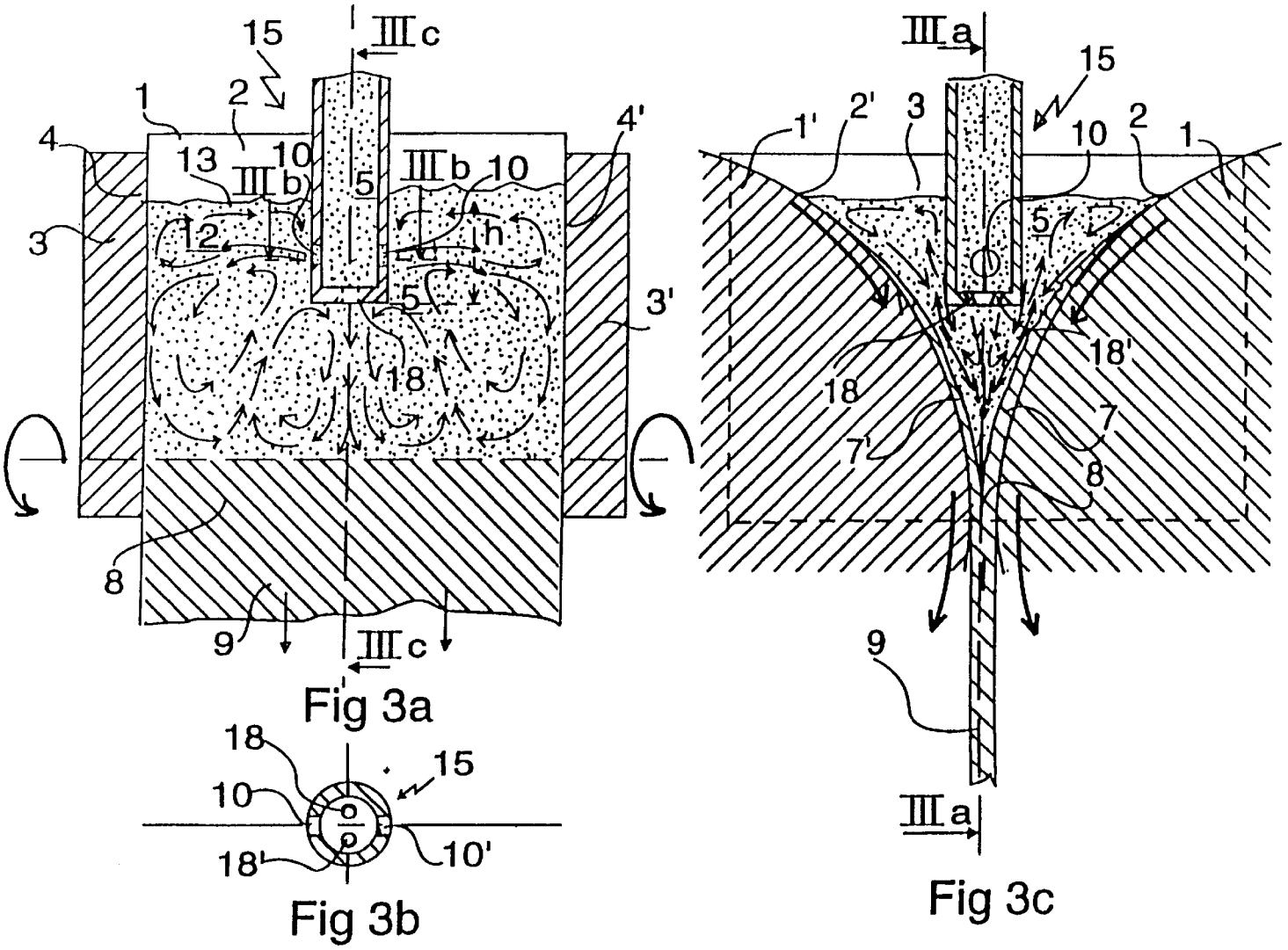
FIG. 3, which shows, in cross section, these flows in the case of a use of a second example of a nozzle according to the invention.

As a variant, as shown in FIGS. 3*a,* 3*b,* 3*c,* it is possible to confer on the bottom holes 18, 18' orientations which are no longer vertical but oblique, making them converge in such a way that the streams which emanate therefrom meet in the longitudinal mid-plane IIIa—IIIa of the casting space. Thus, the desired effect of deep penetration of the jets emanating from the bottom holes is further accentuated.

Figure 4A:
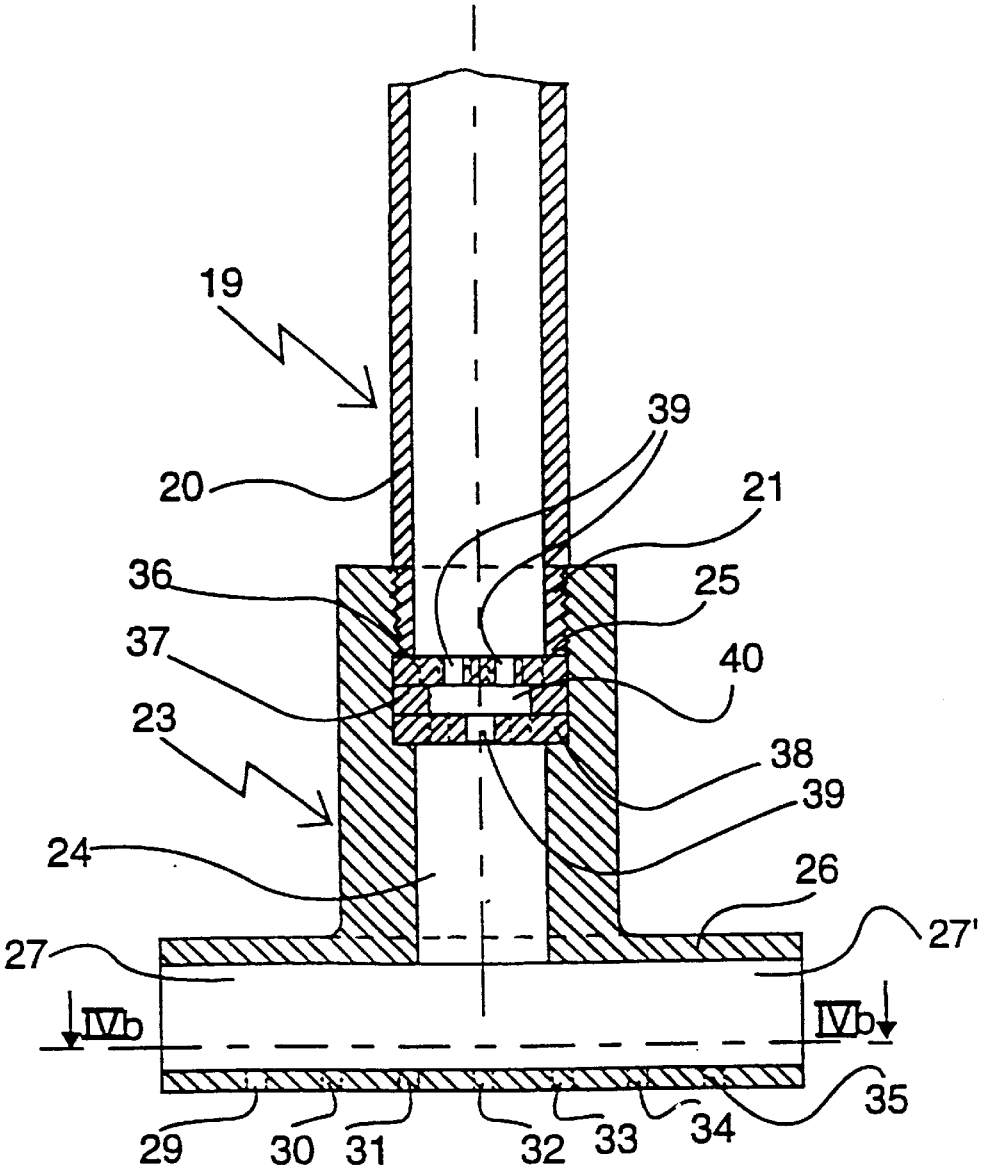
FIGS. 4*a* and 4*b,* which are side and bottom cross-sectional views, respectively, of an alternative embodiment of the nozzle of the invention in the shape of an inverted "T."
Figure 4B:
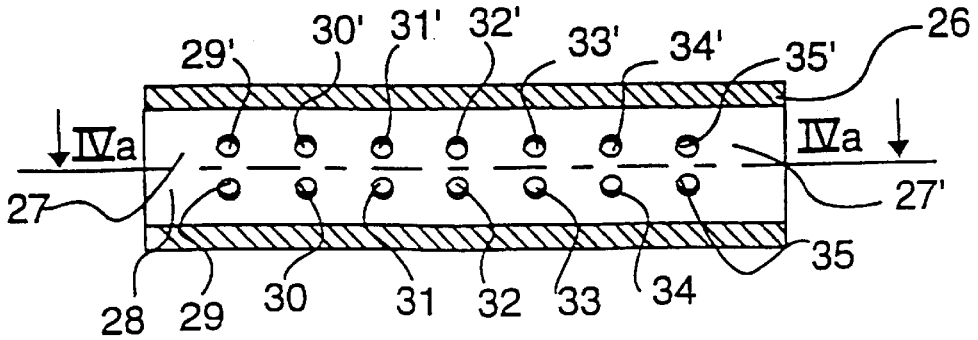

The illustrative embodiment of the invention which has just been described and shown is, of course, not limiting. If the geometry of the nozzle lends itself thereto, it is possible to arrange the use of additional bottom holes, it being essential for them to be distributed on either side of the longitudinal mid-plane of the nozzle, in which the axes of the outlet ports lie. Thus, for example, the invention may be applied to the case of the nozzles as shown in FIGS. 4*a* and 4*b*. These nozzles 19 are formed by two main parts made of refractory which here are joined together by screwing the first into the second. The first part comprises a cylindrical or approximately cylindrical tube 20, the internal space of which constitutes the path via which the liquid metal passes. Its upper part, not shown, is intended to be connected to a continuous-casting tundish. The lower end 21 of the tube has a thread 22 on its outer wall, and this thread 22 allows it to be joined to the second part of the nozzle 19. This second part is composed of a hollow element 23 which, in the example described and shown, has, on the outside, the shape of an upside-down T. The internal space of the hollow element 23, also in the form of an upside-down T, thus has a cylindrical portion 24 extending the internal space of the tube 20. The upper region of this cylindrical portion 24 includes a housing 25 with a threaded wall so as to make it possible for the lower end 21 of the tube 20 to be screwed therein. The cylindrical portion 24 runs out into a tubular portion 26 substantially perpendicular to it and has an approximately square cross section in the example shown (it being understood that this cross section may also be rectangular, circular, oval, etc.) . Each end of this tubular portion 26 has an outlet port 27, 27'. According to the invention, the bottom 28 of the tubular element 26 is equipped with bottom holes 29–35, 29'–35'. They are aligned in two parallel rows arranged on either side of the vertical plane of symmetry IVa—IVa of the tubular element 26. In the example shown, the axes of the bottom holes 29,35, 29'–35' which face each other are convergent in a way similar to the example shown in FIGS. 3*a,* 3*b,* 3*c,* but it is also possible to imagine drilling these same bottom holes 29–35, 29'–35' simply vertically. Of course, the invention applies in the same way if the internal space of the hollow element 23 is given a shape other than that of a simple upside-down T, it being essential for this internal space to terminate in an elongate portion which may be oriented parallel to the large walls of the mold, at the ends of which elongate portion outlet ports have been made.

The bottom holes according to the invention are all the more effective the more uniformly distributed and stable over time the flows inside the nozzle are. For this purpose, it may be recommended to place along the path of the liquid metal inside the nozzle obstacles made of refractory which, by slowing down the flow of metal, also contribute to improving the way in which the nozzle is filled, and therefore to reducing the fluctuations over time of the flows which are established therein. Such obstacles are described in the application FR 95 11375. By way of example, the nozzle 19 in FIG. 4*a* is shown equipped with such an obstacle. The latter consists of a stack of three perforated discs 36, 37, 38 arranged in the lower part of the housing 25 into which is inserted the lower end of the tube 20. The upper disc 36 and the lower disc 38 have relatively small perforations 39 and the perforations of each disc are arranged so as to be offset with respect to the perforations in the other disc. The central disc 37 has a single wide perforation 40 of diameter slightly less than that of the tube 20 and, in fact, acts as a spacer separating the two other discs. This example of an obstacle is, of course, not limiting, and other configurations may be envisaged and also applied to other types of nozzles otherwise in accordance with the invention.

The nozzles of the type according to the invention may, as has been described and shown, be used on plants for the twin-roll continuous casting of thin metal strip. They may also be profitably used for the twin-roll continuous casting of flat metal products of larger cross section, such as steel slabs of conventional thickness (approximately 200 mm) or of lesser thickness. In general, the invention applies to plants for the continuous casting of flat products, the mold of which has a rectangular or approximately rectangular cross section (the dimensions of which may possibly vary over the height of the mold) and the nozzle of which has outlet ports sending the liquid metal toward the side walls of the mold.

We claim:

1. A nozzle for introducing liquid metal into a mold for the continuous casting of flat metal products having two large walls and two side walls, comprising a vertically oriented tube having a lateral wall and a bottom wall, said tube including at its lower end two outlet ports which are made in its lateral wall opposite each other for directing liquid metal each toward a side wall of said mold, and at least two holes made in the bottom wall, wherein a first group of said holes is arranged in said bottom wall on one side of a longitudinal plane of symmetry of the nozzle, which plane includes the axes of the outlet ports, and a second group of said holes is arranged in said bottom wall on the other side of said plane of symmetry, each of said groups of holes being arranged to uniformly distribute liquid metal across the area of its respective side of said bottom wall in a downward direction into said mold, and each hole of said first group being aligned with a hole of said second group in a direction approximately perpendicular to the general orientation of said outlet ports.

2. The nozzle as claimed in claim 1, wherein the holes in the first group are oriented so as to give the liquid metal which is to leave therefrom orientations which are convergent with the orientations given by the holes in said second group to the liquid metal which is to leave therefrom.

3. The nozzle as claimed in claim 1, wherein said lower end is a hollow element, the internal space of which terminates in an elongate portion oriented approximately parallel to the large walls of the mold, at the ends of which elongate portion said outlet ports are made.

4. The nozzle as claimed in claim 3, wherein the internal space of said hollow element is in the form of an upside-downT.

5. The nozzle as claimed in one of claim 1, which includes, inside it, obstacles placed in the path of the liquid metal.

6. The nozzle as claimed in claim 1, wherein said two outlet ports direct liquid metal toward sidewalls formed from rollers which are used in a plant for the direct twin-roll continuous casting of strip.

7. The nozzle as claimed in claim 1, wherein one of each group of holes is disposed over and directs liquid metal into a central middle portion of the mold.

* * * * *